US011352234B2

(12) United States Patent
Inoue et al.

(10) Patent No.: US 11,352,234 B2
(45) Date of Patent: Jun. 7, 2022

(54) IMAGE FORMING APPARATUS

(71) Applicant: Brother Kogyo Kabushiki Kaisha, Nagoya (JP)

(72) Inventors: Masafumi Inoue, Tajimi (JP); Yuichiro Ichinose, Nagoya (JP); Kenta Tosuji, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 176 days.

(21) Appl. No.: 16/781,198

(22) Filed: Feb. 4, 2020

(65) Prior Publication Data

US 2020/0247641 A1 Aug. 6, 2020

(30) Foreign Application Priority Data

Feb. 4, 2019 (JP) ..... JP2019-017577

(51) Int. Cl.

| | |
|---|---|
| ***B65H 85/00*** | (2006.01) |
| ***G03G 15/23*** | (2006.01) |
| ***B65H 9/16*** | (2006.01) |
| ***B65H 1/26*** | (2006.01) |
| ***B65H 5/38*** | (2006.01) |

(52) U.S. Cl.

CPC ..... *B65H 85/00* (2013.01); *B65H 1/266* (2013.01); *B65H 5/38* (2013.01); *B65H 9/166* (2013.01); *G03G 15/234* (2013.01); *B65H 2402/441* (2013.01)

(58) Field of Classification Search

CPC . B65H 1/04; B65H 1/266; B65H 5/38; B65H 9/166; B65H 85/00; B65H 2402/10; B65H 2402/40; B65H 2402/44; B65H 2402/441; B65H 2404/611; B65H 2404/6111; B65H 2405/12; G03G 15/234; G03G 15/6579

See application file for complete search history.

(56) References Cited

U.S. PATENT DOCUMENTS 9,302,884 B2 * 4/2016 Sugiura ..... B41J 13/0045
2012/0228816 A1 * 9/2012 Tomatsu ..... G03G 21/1638 271/3.19

(Continued)

FOREIGN PATENT DOCUMENTS

JP 2011-032023 A 2/2011
JP 2012188271 A * 10/2012 ..... B41J 11/006

*Primary Examiner* — Prasad V Gokhale

(74) *Attorney, Agent, or Firm* — Banner & Witcoff, Ltd.

(57) ABSTRACT

An image forming apparatus includes a main body, an image forming unit, a sheet tray disposed below the image forming unit, and a retransport assembly configured to transport a sheet along a retransport path including first, second, and third retransport path portions in a transport direction. The retransport assembly includes a portion of the sheet tray defining the first retransport path portion, a connecting unit and a retransport unit, which are disposed below the sheet tray. The connecting unit defines the second retransport path portion connected to an upstream end of the third retransport path portion in the transport direction. The retransport unit is movable between a stored position and a pulled-out position. The retransport unit at the stored position defines the first retransport path portion connected to an upstream end of the second retransport path portion in the transport direction.

14 Claims, 9 Drawing Sheets

(56) References Cited

U.S. PATENT DOCUMENTS

| | | | | |
|---|---|---|---|---|
| 2013/0082433 | A1* | 4/2013 | Hashimoto | B65H 85/00 271/3.14 |
| 2014/0117617 | A1* | 5/2014 | Inoue | G03G 21/1638 271/265.01 |
| 2020/0249613 | A1* | 8/2020 | Tosuji | B65H 9/166 |

* cited by examiner

IMAGE FORMING APPARATUS

CROSS-REFERENCE TO RELATED APPLICATION

This application claims priority from Japanese Patent Application No. 2019-017577 filed on Feb. 4, 2019, the content of which is incorporated herein by reference in its entirety.

TECHNICAL FIELD

Aspects of the disclosure relate to an image forming apparatus.

BACKGROUND

A known image forming apparatus includes an image forming unit configured to form an image on one side of a sheet and to form an image on the other side of the sheet transported, along a retransport path, back to the image forming unit.

The known image forming apparatus further includes a retransport assembly disposed below a sheet cassette to partially define the retransport path. A user is allowed to remove any sheet jammed in the retransport path by pulling out the retransport assembly from a main body of the apparatus.

SUMMARY

Removal of any sheet jammed in a retransport path by pulling out a member partially defining a retransport path may be achieved in other structures than that of the known image forming apparatus.

Aspects of the disclosure provide an image forming apparatus configured to allow pulling out of an element partially defining a retransport path from a main body of the apparatus, thereby facilitating removal of any sheet jammed in the retransport path.

According to one or more aspects of the disclosure, an image forming apparatus includes a main body, an image forming unit, a sheet tray, and a retransport assembly. The image forming unit is disposed at the main body and configured to form an image on a sheet. The sheet tray is disposed below the image forming unit, extends horizontally, and is configured to hold sheets to be fed to the image forming unit. the retransport assembly is configured to transport, along a retransport path, a sheet having an image on one side thereof back toward the image forming unit to form an image on the other side of the sheet, the retransport path including a first retransport path portion, a second retransport path portion, and a third retransport path portion in a transport direction. The retransport assembly includes a particular portion of the sheet tray, a connecting portion, and a retransport unit. The particular portion defines the third retransport path portion. The connecting unit is disposed below the sheet tray, extends horizontally, and defines the second retransport path portion connected to an upstream end of the third retransport path portion in the transport direction. The retransport unit is disposed below the sheet tray, extends horizontally, and is movable between a stored position at which the retransport unit is stored inside the main body and, a pulled-out position at which the retransport unit is pulled out from the stored position. The retransport unit at the stored position defines the first retransport path portion connected to an upstream end of the second retransport path portion.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

An illustrative embodiment of the disclosure will be described with reference to the drawings.

Illustrative Embodiment

Figure 1:
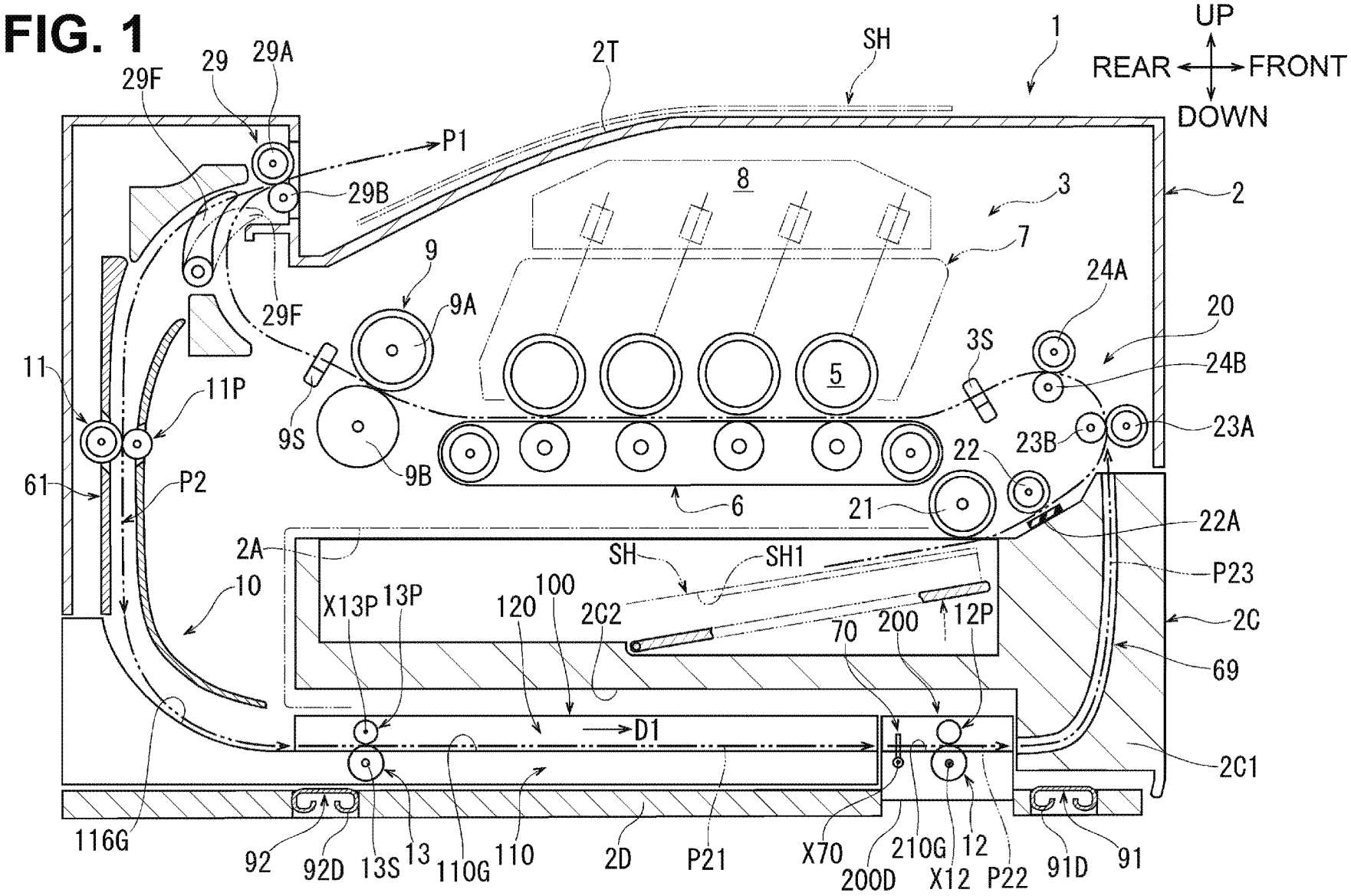
FIG. 1 is a schematic cross-sectional view of an image forming apparatus according to an illustrative embodiment of the disclosure.

FIG. 1 shows an image forming apparatus 1 according to an illustrative embodiment of the disclosure. The image forming apparatus 1 is a color laser printer for electrophotographically forming an image of a plurality of colors on a sheet.

A front-rear direction and an up-down direction are shown in FIG. 1 by defining right and upper sides of the page of FIG. 1 as front and upper sides of the image forming apparatus 1, respectively. A left-hand side of the apparatus 1 when viewed from the front side, i.e., a side facing out of the page of FIG. 1, is defined as a left side of the apparatus 1. A front-rear direction, a left-right direction, and an up-down direction shown in FIG. 2 and subsequent drawings correspond to the directions shown in FIG. 1. Elements of the image forming apparatus 1 will now be described with reference to FIG. 1 and other drawings.

Structures of Main Body, Transfer Path, Feeder, Image Forming Unit, and Discharge Unit As shown in FIG. 1, the image forming apparatus 1 includes a main body 2, a feeder 20, an image forming unit 3, and a discharge unit 29.

The main body 2 includes a housing and an inner frame disposed inside the housing (not shown). The inner frame includes a pair of side frames 90L and 90R schematically shown in FIG. 2. The side frames 90L and 90R are disposed on left and right sides of the main body 2, respectively. The side frames 90L and 90R face each other in the left-right direction and extend in the front-rear direction and in the up-down direction.

A first coupling member 91 and a second coupling member 92, shown in FIG. 1, are part of the inner frame. The first coupling member 91 and the second coupling member 92 are disposed below the sheet tray 2C and partially constitute a bottom wall 2D of the main body 2. The first coupling member 91 is disposed at a front portion of the main body 2. The first coupling member 92 is disposed at a rear portion of the main body 2.

As schematically shown in 2, the first coupling member 91 and the second coupling member 92 extend in the left-right direction. The first coupling member 91 is coupled, at its right end, to the side frame 90R and, at its left end, to the side frame 90L. The second coupling member 92 is coupled, at its right end, to the side frame 90R and, at its left end, to the side frame 90L.

As shown in FIG. 1, a sheet tray receptacle 2A is provided in the main body 2. The sheet tray receptacle 2A is an inner space open to a lower portion of the front of the main body 2 and recessed toward the rear of the main body 2.

A sheet tray 2C is attached to the sheet tray receptacle 2A. The sheet tray 2C has a substantially box shape extending substantially horizontally and is open upward. The sheet tray 2C stores therein a stack of sheets SH which undergo image forming. Sheets SH include plain paper sheets, transparent sheets, and cardboard sheets.

Figure 2:
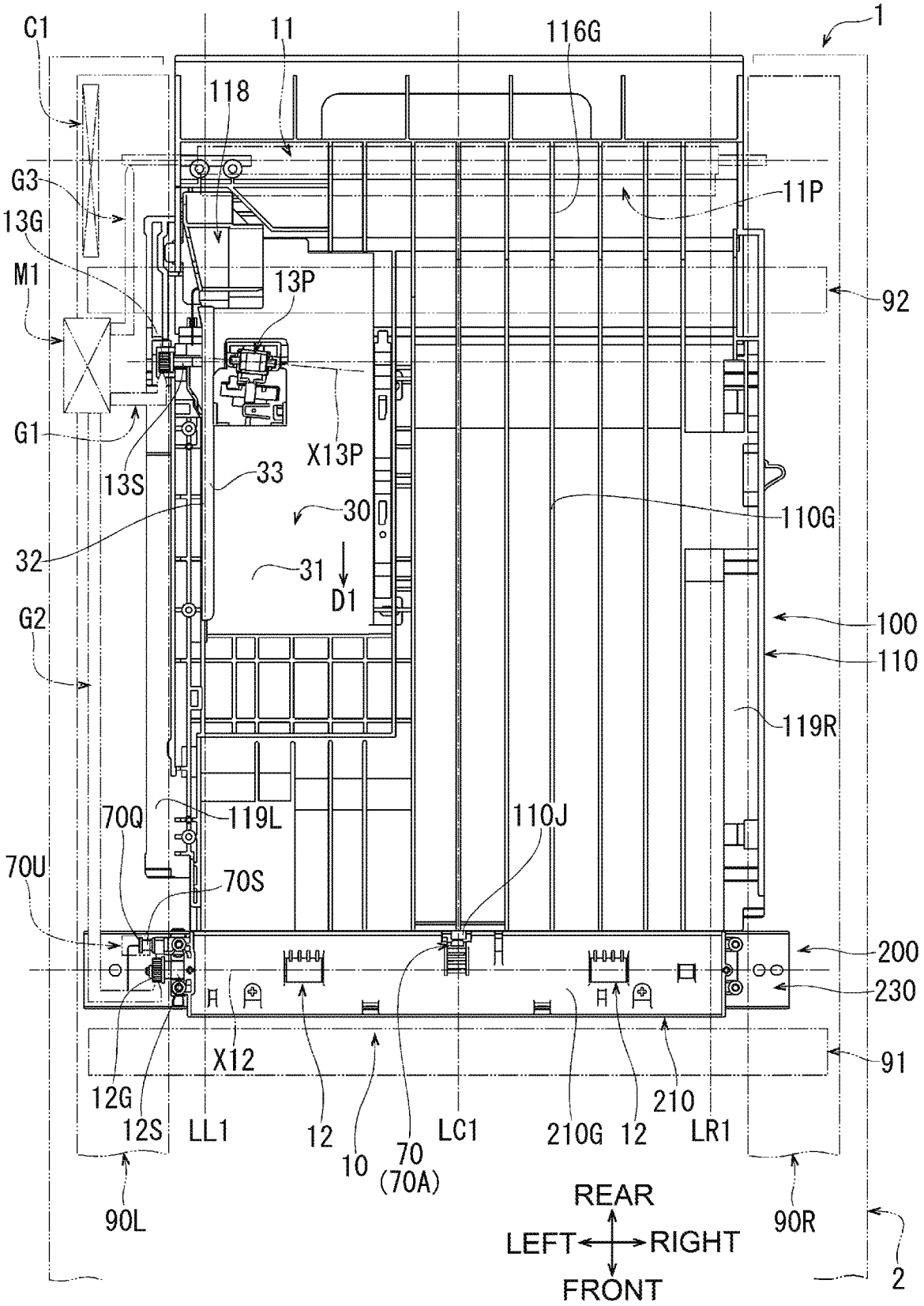
FIG. 2 is a partial top view of the image forming apparatus, mainly showing a main body, a retransport unit from which a cover is removed, and a connecting unit from which an upper beam and a facing member are removed.

The side frames 90L and 90R shown in FIG. 2 are respectively positioned on a left side, i.e. a side out of the page of FIG. 1, and at a right side, i.e., a side into the page of FIG. 1. The side frames 90L and 90R support the sheet tray 2C such that the sheet tray 2C is able to be pulled out frontward in a pulling direction. The sheet tray 2C is loadable with sheets SH when pulled out frontward from the sheet tray receptacle 2A.

A discharge tray 2T is disposed at the top of the main body 2. A sheet SH having an image formed thereon is discharged onto the discharge tray 2T.

The feeder 20, the image forming unit 3, and the discharge unit 29 are disposed inside the main body 2 at a position above the sheet tray receptacle 2A and the sheet tray 2C. The feeder 20, the image forming unit 3, and the discharge unit 29 are assembled to the inner frame (not shown).

As schematically shown in FIG. 2, a controller C1 and a drive source M1 are disposed inside the main body 2. The controller C1 may be a microcomputer including a central processing unit (CPU), a read only memory (ROM), and a random access memory (RAM) which are not shown. The ROM stores therein programs for controlling various operations of the image forming apparatus 1 and programs for identification. The RAM is used as a storage area for temporarily storing data and signals used by the CPU to execute the above-described programs, and a working area for data processing. In this illustrative embodiment, the controller C1 and the drive source M1 are disposed between a left surface of the main body 2 and the left side frame 90L. The feeder 20, the image forming unit 3, and the discharge unit 29 are controlled by the controller C1 and operated upon receipt of a drive force transmitted via a drive force transmitter (not shown).

As shown in FIG. 1, a transport path P1 is defined in the main body 2. The transport path P1 is substantially S-shaped. The transport path P1 extends from a front end of the sheet tray 2C upward to curve in a U shape, extends rearward substantially horizontally, and then extends, at the rear of the main body 2, upward in a U shape to the discharge tray 2T.

In the feeder 20, a feed roller 21 feeds from the sheet tray 2C one sheet SH at a time, separated by a separation roller 22 and a separation pad 22A, to the transport path P1. Then, a transport roller pair 23A and 23B, and a registration roller pair 24A and 24B disposed at the U-shaped portion of the transport path P1 transport the sheet SH toward the image forming unit 3.

A sensor 3S is disposed between the registration roller pair 24A and 24B, and the image forming unit 3. A known optical sensor, such as a photo-interrupter, is used as the sensor 3S to detect an actuator pivoting upon being contacted by a sheet.

When the sensor 3S detects a sheet SH transported by the registration roller pair 24A and 24B, the detection result is transmitted to the controller C1. The controller C1 determines, on the basis of the detection result, a timing when the sheet SH reaches the image forming unit 3 and controls timings for starting and stopping the above-described various elements.

The image forming unit 3 is of the direct tandem type capable of color printing. The image forming unit 3 has a known structure including a process cartridge 7, a transfer belt 6, a scanner 8, and a fixer 9.

The process cartridge 7 is a group of four cartridges corresponding to black, yellow, magenta, and cyan toners and arranged in series or tandem along a substantially horizontal portion of the transport path P1. The four cartridges of the process cartridge 7 each includes, for a corresponding toner color, a photosensitive drum 5, a developing roller (not shown), a charger, and a toner storage.

A transfer belt 6 is disposed below the photosensitive drums 5 to define therebetween the substantially horizontal portion of the transport path P1. The transfer belt 6 circulates while cooperating with the photosensitive drums 5 to nip a sheet being transported.

A scanner 8 includes laser sources, a polygon mirror, f-theta lenses, and reflecting mirrors. The scanner 8 emits laser beams downward to irradiate respective photosensitive drums 5 in the process cartridge 7.

A fixer 9 is disposed further to the rear than the process cartridge 7. The fixer 9 includes a heat roller 9A positioned on an upper side of the transport path P1, and a pressure roller 9B pressed upward toward the heat roller 9A to define the transport path P1 therebetween. The heat roller 9A and the pressure roller 9B of the fixer 9 heat and press a sheet SH having passed below the process cartridge 7.

A sensor 9S is disposed further to the rear than the heat roller 9A and the pressure roller 9B in the transport path P1. The sensor 9S has the same structure as the sensor 3S.

When the sensor 9S detects a sheet SH transported past the fixer 9, the detection result is transmitted to the controller C1. The controller C1 determines, on the basis of the detection result, a timing when the sheet SH leaves the image forming unit 3 and controls timings for starting and stopping the above-described various elements.

The discharge unit 29 includes a discharge roller 29A, a discharge pinch roller 29B, and a flap 29F. The discharge roller 29A and the discharge pinch roller 29B are positioned most downstream in the transport path P1.

The flap 29F is disposed in the main body 2 at a position further to the rear than and partially lower than the discharge roller 29A and the discharge pinch roller 29B. A lower end of the flap 29F is supported by a frame member (not shown) pivotably between a position shown by a solid line in FIG. 1 and a position shown by a two-dot dashed line in FIG. 1.

The flap 29F is retained by a spring (not shown) at the position shown by the two-dot dashed line in FIG. 1. When a sheet SH is transported along the transport path P1 toward the discharge tray 2T, the flap 29F is pushed by the sheet SH to pivot to the position shown by the solid line in FIG. 1, thereby not interfering with transport of the sheet SH.

The image forming unit 3 forms an image on a sheet SH transported along the transport path P1, as described below. As a photosensitive drum 5 in each of the four cartridges rotates, the surface of the photosensitive drum 5 is uniformly and positively charged by an associated charger, and then the surface of the photosensitive drum 5 is irradiated with a laser beam scanned at high speed by the scanner 8. An electrostatic latent image, which corresponds to an image to be formed on the sheet SH, is formed on the surface of the photosensitive drum 5. Subsequently, toner is supplied from an associated corresponding toner storage onto the surface of the photosensitive drum 5, in accordance with an electrostatic latent image on the photosensitive drum 5. In a state in which a sheet SH is stored in the sheet tray 2C, one side SH1 of the sheet SH faces down. When the sheet SH is transported along the transport path P1 and passes through the image forming unit 3, the one side SH1 of the sheet SH faces up to the photosensitive drums 5. Thus, the toner carried on the surface of the photosensitive drum 5 is transferred onto the one side SH1 of the sheet SH, and the transferred toner is heated and pressed by the fixer 9. Consequently, the transferred toner is fixed onto the sheet SH.

The sheet SH transported past the fixer 9 is pinched by the discharge roller 29A and the discharge pinch roller 29B, and is discharged onto the discharge tray 2T by the discharge roller 29A rotating forward.

Overall Structures of Retransport Path and Retransport Assembly

A retransport path P2 is defined in the main body 2 to allow image forming also on the other side of a sheet SH opposite to the one side SH1. The retransport path P2 extends downward from the discharge unit 29 along a rear surface of the main body 2 and is redirected to extend, below the sheet tray 2C, frontward substantially horizontally. Then, the retransport path P2 is redirected at a position near the front of the main body 2 to extend upward and merge into a position between the separation roller 22 and the transport roller pair 23A and 23B.

A sheet SH is transported along the retransport path P2 in a transport direction D1. The transport direction D1 is changed from downward to frontward to be substantially horizontal, and is further changed to upward. A width direction of a sheet SH transported along the retransport path P2 corresponds to the left-right direction.

The discharge unit 29 also serves as a switch-back mechanism configured to switch back a sheet SH transported along the transport path P1 and to transport the sheet SH into the retransport path P2. Specifically, the controller C1 switches the discharge roller 29A rotating in a forward direction to rotate in a reverse direction at a predetermined timing after the sensor 9S ceases to detect a trailing edge of a sheet SH in the middle of discharging the sheet SH toward the discharge tray 2T by the discharge roller 29A and the discharge pinch roller 29B which pinch the sheet SH therebetween. The predetermined timing is set such that the sheet SH is switched back after the flap 29F pivots to the position shown by the two-dot dashed line in FIG. 1 upon passing of the trailing edge of the sheet SH past the flap 29F. Consequently, the sheet SH is transported toward the retransport path P2 by the discharge roller 29A rotating in the reverse direction, the discharge pinch roller 29B, and the flap 29F located at the position shown by the two-dot dashed line in FIG. 1.

The image forming apparatus 1 includes a retransport assembly 10. The retransport assembly 10 includes a switch-back guide 61 shown in FIGS. 1 and 3, a retransport unit 100 shown in FIGS. 1 through 6 and 9, a connecting unit 200 shown in FIGS. 1 through 5, 8, and 9, and a return guide 69 shown in FIGS. 1 and 3.

In the retransport assembly 10, the switch-back guide 61, the retransport unit 100, the connecting unit 200, and the return guide 69 transport a sheet SH, switched back by the discharge unit 29, back to the image forming unit 3 along the retransport path P2. After the image forming unit 3 forms an image on the other side of the sheet SH opposite to the one side SH1, the sheet SH is discharged onto the discharge tray 2T. A specific structure of the retransport assembly 10 will now be described in detail.

Structures of Switch-Back Guide and First Transport Roller

The switch-back guide 61 defines a portion of the retransport path P2 such that the portion extends downward from the discharge unit 29 along the rear surface of the main body 2. A first transport roller 11 and a pinch roller 11P are disposed at a middle of the switch-back guide 61 in the transport direction D1.

The first transport roller 11 is rotatable about an axis, which is parallel to the width direction, to transport a sheet SH straight. The pinch roller 11P is pressed against the first transport roller 11. As shown in FIG. 2, the first transport roller 11 and the pinch roller 11P, which hereinafter may be collectively referred to as a first transport roller pair 11 and 11P, are elongated in the left-right direction to have a sufficient length for nipping the sheet SH in the width direction.

The left side frame 90L includes a third transmitter G3. The third transmitter G3, which is only schematically shown, includes a plurality of gears and transmission shafts to transmit a drive force from the drive source M1 to the first transport roller 11. The third transmitter G3 may include a clutch configured to switch between transmission and block of the drive force from the drive source M1.

As shown in FIG. 1, the first transport roller 11 and the pinch roller 11P nip a sheet SH switched back by the discharge unit 29 and transport the sheet SH toward the retransport unit 100.

Structure of Return Guide

The return guide 69 is disposed inside a front end portion of the sheet tray 2C. Specifically, the front end portion of the sheet tray 2C includes an extending portion 2C1. The extending portion 2C1 extends downward beyond a bottom surface 2C2 of the sheet tray 2C to a position near a bottom wall 2D. The extending portion 2C1 is an example of a particular portion of a sheet tray.

An entrance of the return guide 69 is open to a rearward facing surface of the extending portion 2C1. An exit of the return guide 69 is open to an upward facing surface of the front end portion of the sheet tray 2C. The return guide 69 defines, in the retransport path P2, a portion redirected from frontward to upward and extending upward to merge into the transport path P1.

The portion defined by the return guide 69 is a third retransport path portion P23 through which a sheet SH passes inside the return guide 69 frontward and then toward a junction with the transport path P1. An upstream end of the third retransport path portion P23 in the transport direction D1 is located at the extending portion 2C1.

Structures of Retransport Unit, Skew Roller, and Drive Roller

The retransport unit 100 is disposed below the sheet tray 2C and extends horizontally. The retransport unit 100 defines, in the retransport path P2, a curved portion changing the transport direction from downward to frontward, and a portion of a substantially horizontal portion extending frontward. The portion of the substantially horizontal portion defined by the retransport unit 100 is referred to as a first retransport path portion P21.

The retransport unit 100 is movable between a stored position (shown in FIG. 1) at which the retransport unit 100 is stored in the main body 2, and a pulled-out position (shown in FIG. 3) at which the retransport unit 100 is pulled out rearward. In this illustrative embodiment, the retransport unit 100, when at the pulled-out position, is entirely outside the main body 2. Although shown in FIG. 3 as positioned below the image forming apparatus 1, the retransport unit 100 is actually pulled out rearward horizontally.

Pulling out the retransport unit 100 from the stored position to the pulled-out position allows a user to remove any sheet SH jammed in the retransport path P2.

Figure 4:
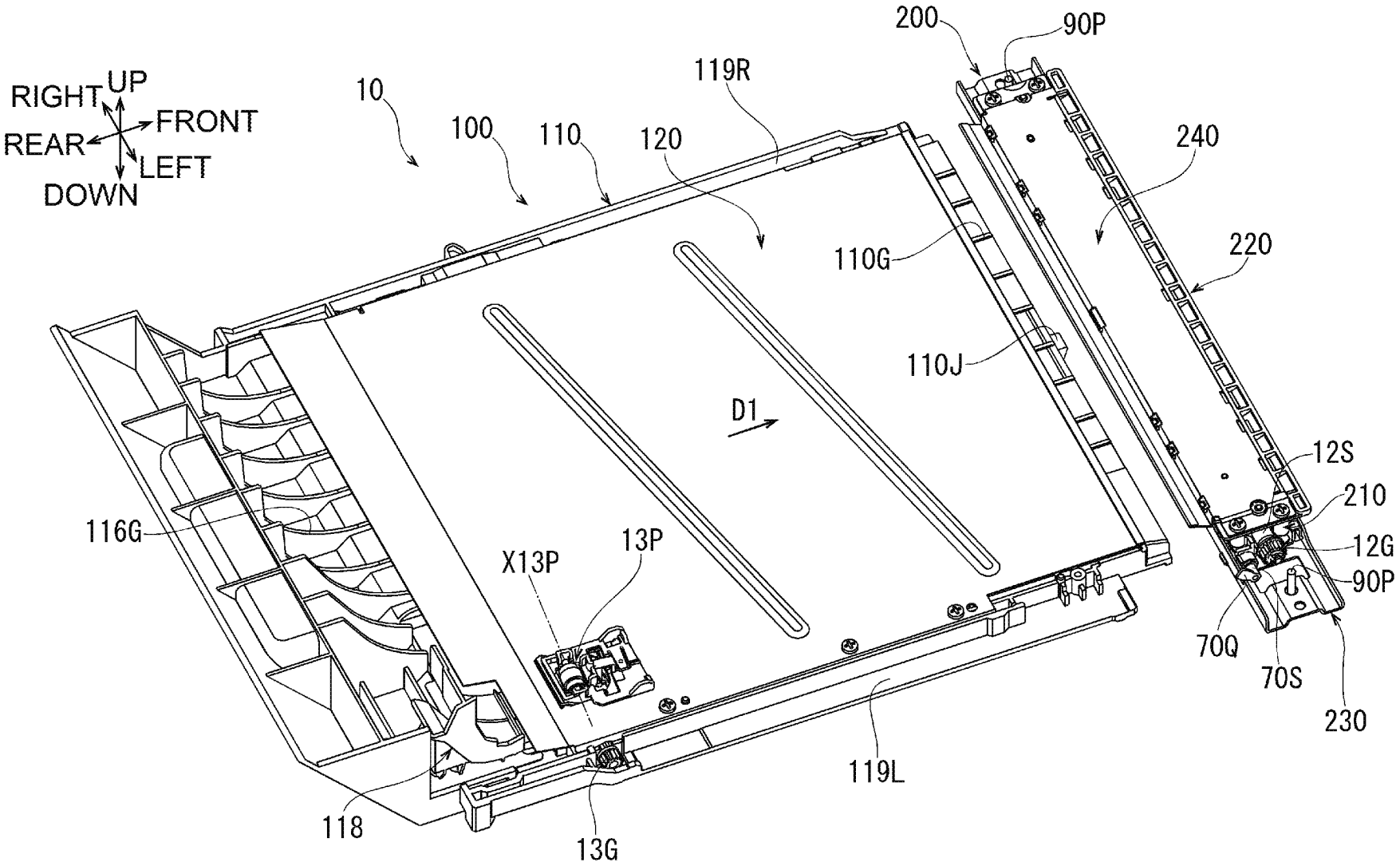
FIG. 4 is a perspective view of the retransport unit and the connecting unit.
Figure 5:
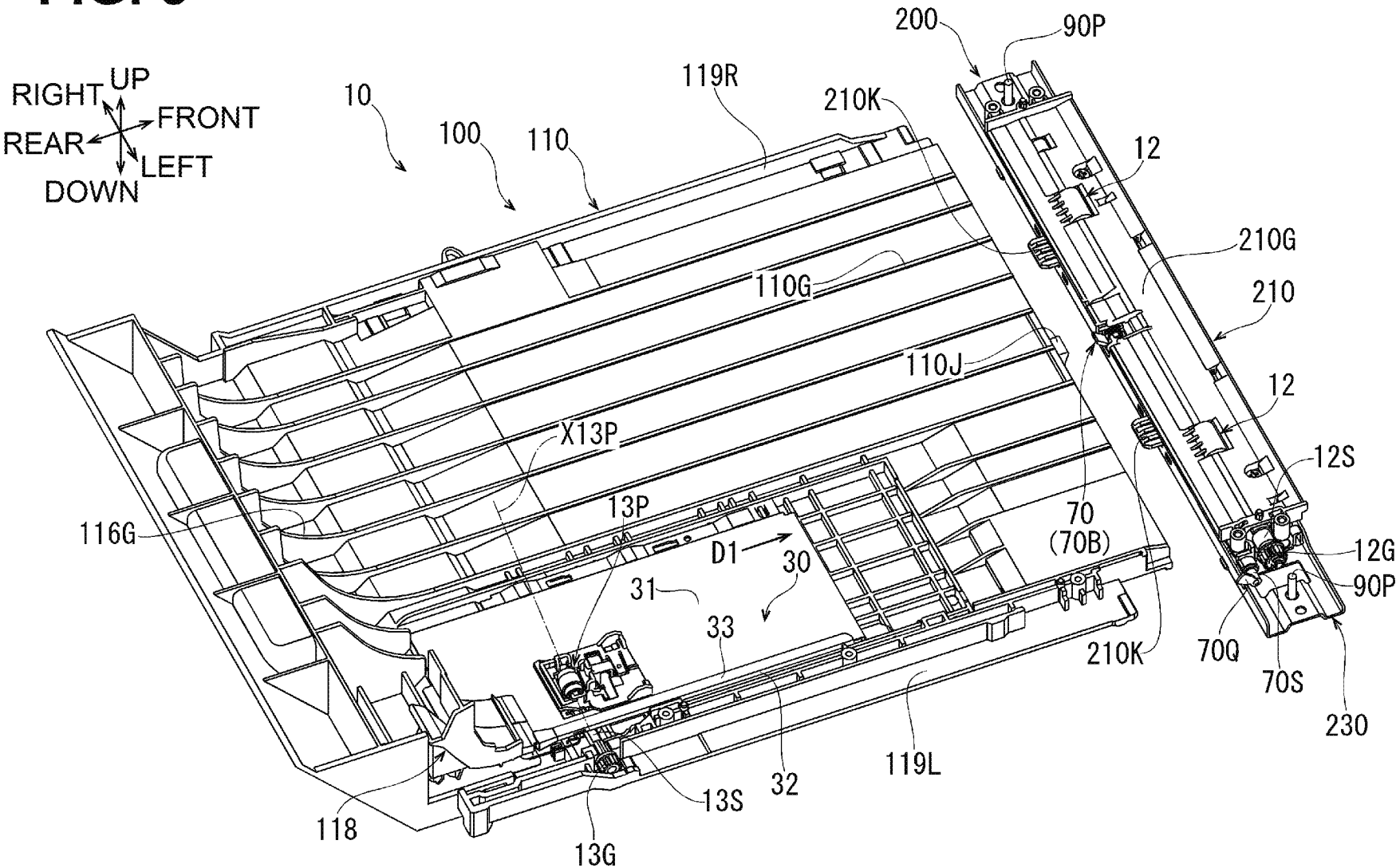
FIG. 5 is a perspective view showing the retransport unit from which the cover is removed, and the connecting unit from which the facing member is removed.

As shown in FIG. 4, the retransport unit 100 includes a first guide member 110 and a cover 120. In FIGS. 2 and 5, the cover 120 is removed from the retransport unit 100.

As shown in FIGS. 2, 4, and 5, the first guide member 110 includes, on its left and right sides, guide ribs 119L and 119R. The guide ribs 119L and 119R extend, in the width direction, beyond the left and right sides of the first guide member 110, respectively.

Figure 3:
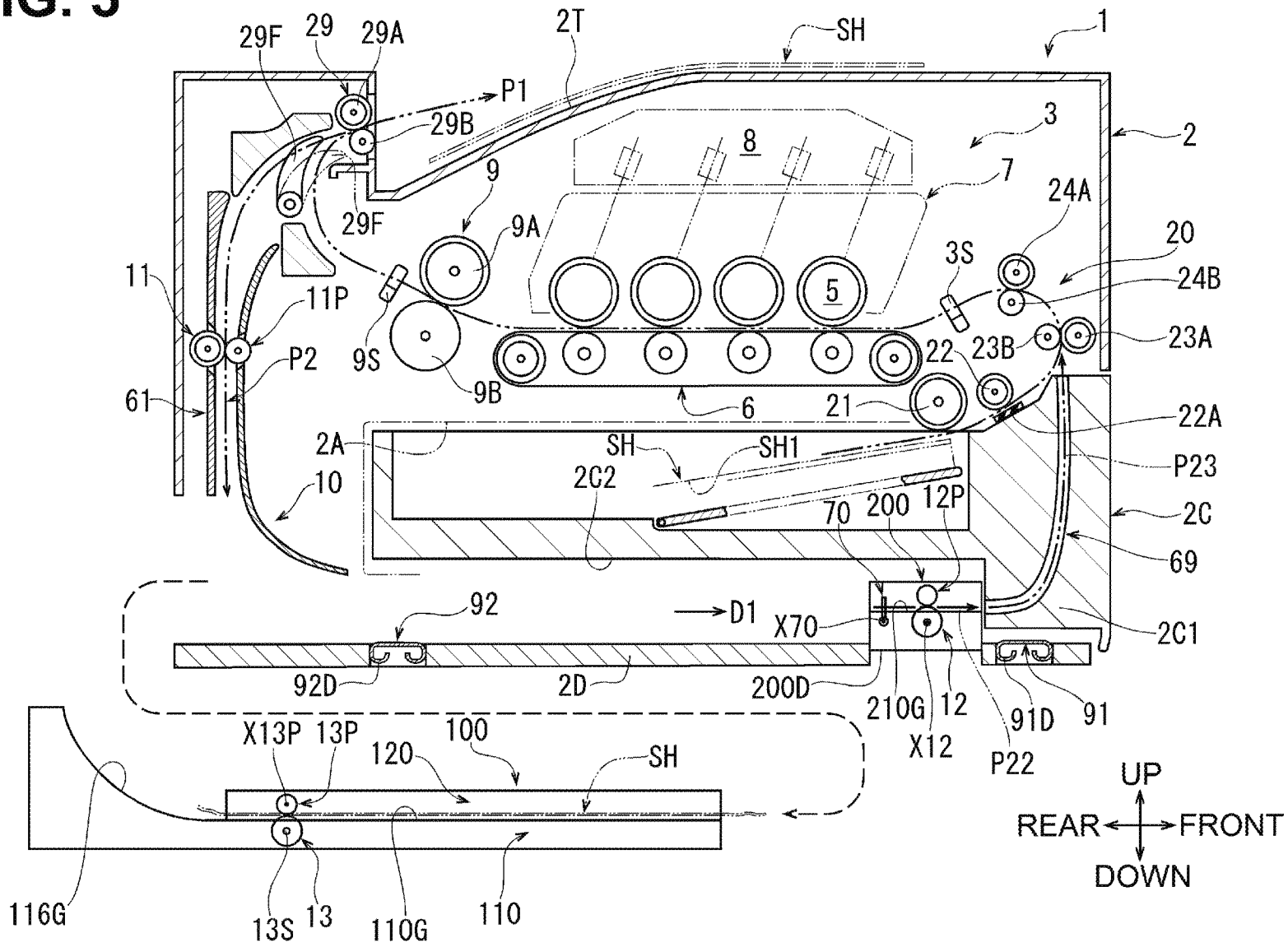
FIG. 3 is a schematic cross-sectional view of the image forming apparatus, showing the retransport unit moved to and located at a pulled-out position.

When the guide ribs 119L and 119R are guided by guide rails (not shown) formed in the side frames 90L and 90R shown in FIG. 2, the retransport unit 100 moves between the stored position (shown in FIG. 1) and the pulled-out position (shown in FIG. 3). The retransport unit 100 shown in FIG. 2 is positioned at the stored position.

As shown in FIGS. 1, 2, and 5, the first guide member 110 includes, on its upper surface, a curved transport surface 116G and a first transport surface 110G.

The curved transport surface 116G is positioned at a rear end of the first guide member 110 and defines the curved portion of the retransport path P2 which changes the transport direction from downward to frontward. The curved transport surface 116G is a curved surface substantially formed by distal ends of a plurality of ribs.

As shown in FIGS. 2 and 5, a side chute 118 is assembled to a left end of the curved transport surface 116G. The side chute 118 guides a left edge of a sheet SH guided on the curved transport surface 16G.

The first transport surface 110G is connected to a front end of the curved transport surface 116G and extends substantially horizontally to a front end of the first guide member 110. The first transport surface 110G defines from below the first retransport path portion P21. The first transport surface 110G is a substantially flat surface formed by distal ends of a plurality of ribs.

As shown in FIG. 2, an imaginary line passing through a center of the first transport surface 110G in the width direction and extending in the transport direction D1 is defined as a centerline LC1. An imaginary line extending, at a left end of the first transport surface 110G, in parallel with the centerline LC1 is defined as a left reference line LL1. An imaginary line extending, at a right end of the first transport surface 110G, in parallel with the centerline LC1 is defined as a right reference line LR1.

A distance in the width direction between the left reference line LL1 and the right reference ling LR1 is set to be equal to a length in the width direction of a sheet SH, which is transported on the first transport surface 110G. In the width direction, a distance between the centerline LC1 and the left reference line LL1 is set to be equal to a distance between the centerline LC1 and the right reference ling LR1.

By aligning a left edge of a sheet SH transported on the first transport surface 110G with the left reference line LL1, a center of the sheet SH in the width direction aligns with the centerline LC1. The centerline LC1 also aligns with a center of the image forming unit 3 in the width direction.

As shown in FIGS. 2 and 5, a reference guide 30 is aligned to an end, e.g., to a left end, in the width direction of the first transport surface 110G of the first guide member 110. The reference guide 30, which may be a sheet metal member, is substantially C-shaped in cross section and includes a lower wall 31, a reference wall 32, and an upper wall 33. The reference guide 30 is assembled to the first guide member 110 such that the lower wall 31 is flush with the first transport surface 110G and that the reference wall 32 is positioned on the left reference line LL1 and extends along the transport direction D1.

Figure 9:
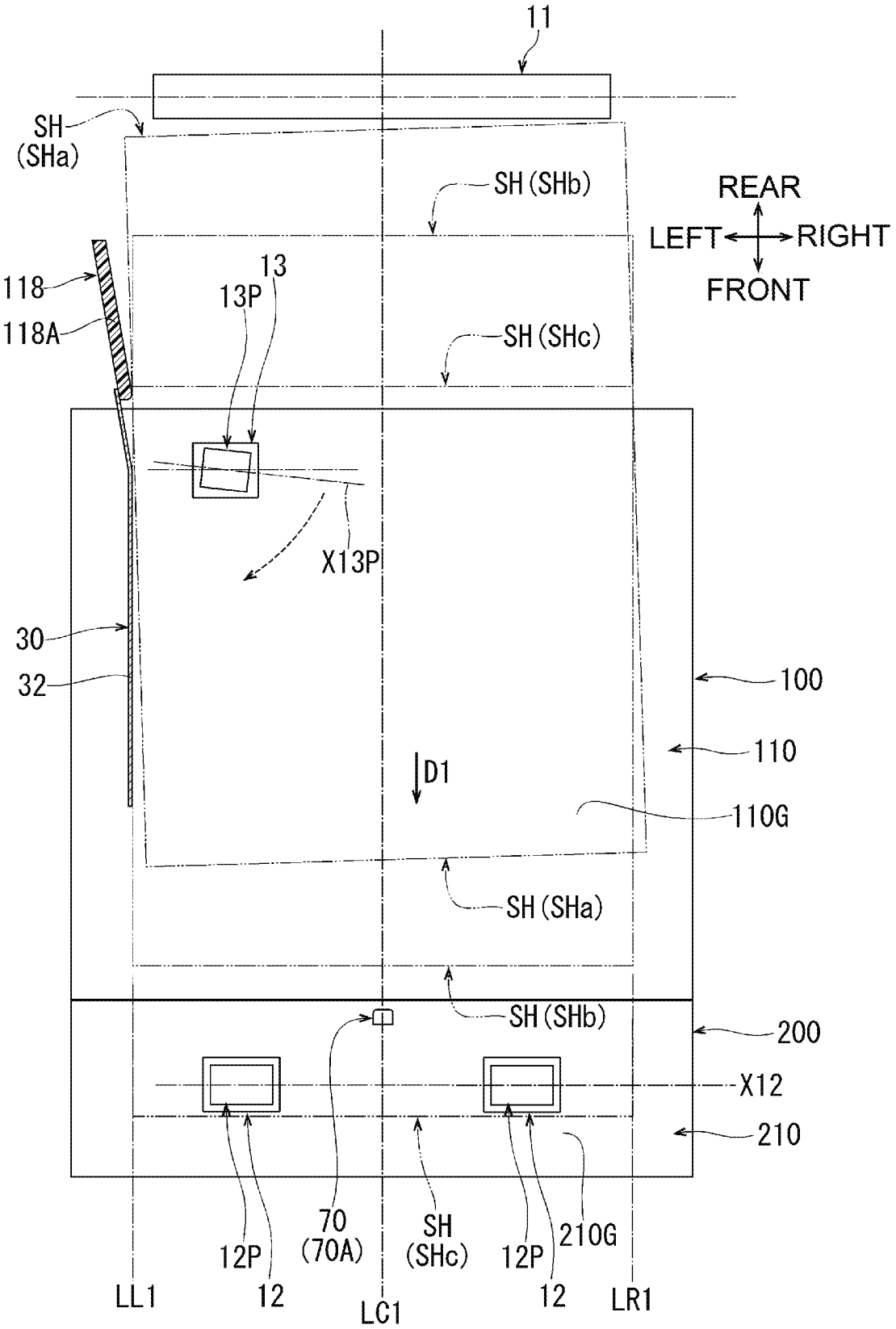
FIG. 9 is a schematic top view of the retransport unit, illustrating how a skew roller and a reference guide act on a sheet.

As shown in FIG. 9, the reference wall 32 of the reference guide 30 is bent at its rear end portion such that a more upstream portion of its rear end portion in the transport direction D1 is offset further to the left from the left reference line LL1. A front end of a side wall 118A of the side chute 118 is adjacent to the right of the rear end of the reference wall 32 and is in contact with the left reference line LL1. The side wall 118A is inclined such that a more upstream portion of the side wall 118A in the transport direction D1 is offset further to the left from the left reference line LL1. A cylindrical pin may be disposed at a front end of the side wall 118A of the side chute 118.

As shown in FIG. 4, the cover 120, which may be a sheet metal member, covers over a substantially entirety of the first transport surface 110G of the first guide member 110. The cover 120 holds, at its rear left end portion, a skew roller 13P.

In FIGS. 2 and 5, the skew roller 13P is shown at the same position as that shown in FIG. 4, and a drive roller 13 shown in FIG. 1 as disposed below the skew roller 13P is invisible. As shown in FIG. 2, the skew roller 13P is rotatable about a first axis X13P which is inclined relative to the width direction. The first axis X13P is inclined such that a right end of the skew roller 13P is positioned further to the front than a left end of the skew roller 13P.

As shown in FIG. 1, the drive roller 13 is rotatably supported by the first guide member 110. The drive roller 13 is in contact, from below, with the skew roller 13P to define the first retransport path portion P21 therebetween.

As shown in FIG. 5, a rotation shaft 13S of the drive roller 13 extends in the left-right direction of the drive roller 13 and a left end of the rotation shaft 13S is exposed from a left side of the first guide member 110. A spur gear 13G is fixed to the left end of the rotation shaft 13S.

As shown in FIG. 2, a first transmitter G1 is disposed at the left side frame 90L. The first transmitter G1, which is only schematically shown, includes a plurality of gears and transmission shafts to transmit a drive force from the drive source M1 to the skew roller 13P via the spur gear 13G, the rotation shaft 13S, and the drive roller 13. The first transmitter G1 may include a clutch configured to switch between transmission and block of the drive force from the drive source M1.

The first transmitter G1 includes a spur gear (not shown) which rearwardly meshes with the spur gear 13G. The spur gear 13G leaves the spur gear of the first transmitter G1 when the retransport unit 100 moves from the stored position (shown in FIG. 1) toward the pulled-out position (shown in FIG. 3), and meshes with the spur gear of the first transmitter G1 when the retransport unit 100 moves from the puled-out position toward the stored position.

The skew roller 13P and the drive roller 13, which hereinafter may be collectively referred to as skew roller pair 13, nip, on the first transport surface 110G, a sheet SH transported by the first transport roller 11 and the pinch roller 11P, and transport the sheet SH toward the connecting unit 200. In this case, the skew roller 13P, which rotates about the inclined first axis X13P as the drive roller 13 rotates, transports the sheet SH in a skewed manner toward the reference wall 32.

Figure 6:
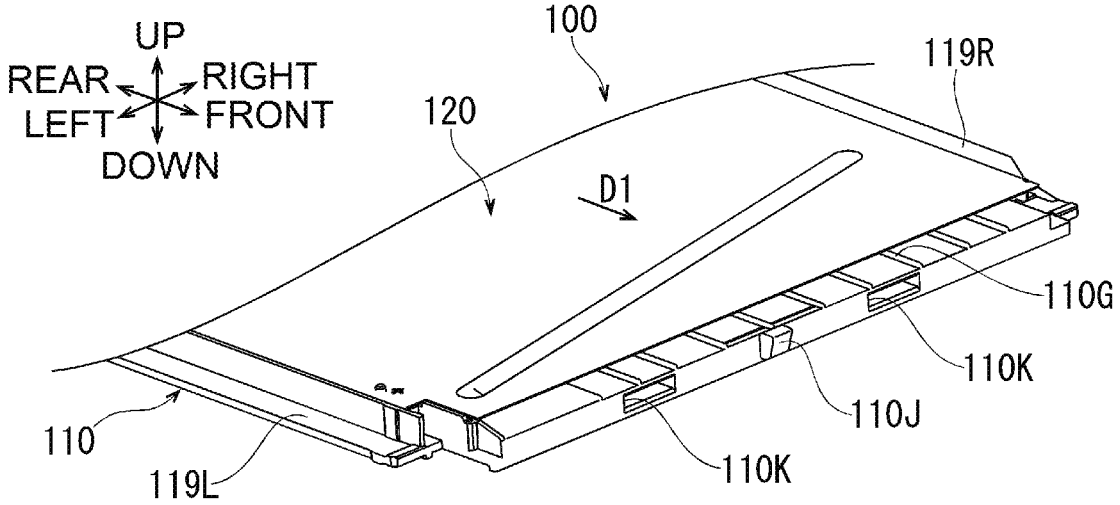
FIG. 6 is a partial perspective view of the retransport unit, showing a positioning recess.

As shown in FIG. 6, the first guide member 110 of the retransport unit 100 has, at its front end face, two positioning recesses 110K. Each positioning recess 110K is a substantially rectangular hole recessed rearward from the front end face of the first guide member 110. The positioning recesses 110K are spaced from each other in the width direction.

The first guide member 110 also includes, at the center in the width direction of the front end face, an actuator pusher 110J protruding frontward.

Structures of Connecting Unit, Second Transport Roller, and Actuator

As shown in FIG. 1, the connecting unit 200 is disposed below the sheet tray 2C and extends horizontally. The connecting unit 200 is arranged with the retransport unit 100 and the extending portion 2C1 of the sheet tray 2C in the front-rear direction.

The connecting unit 200 defines, in the retransport path P2, a substantially horizontal portion extending frontward. The substantially horizontal portion extending frontward is referred to as a second retransport path portion P22.

The second retransport path portion P22 is connected to a downstream end of the first retransport path portion P21 and to the upstream end of the third retransport path portion P23 in the transport direction D1. In short, the retransport path P2 has the first retransport path portion P21, the second retransport path portion P22, and the third retransport path portion P23 in this order in the transport direction D1.

A substantially horizontal portion of the retransport path P2 is divided into the first retransport path portion P21 and the second retransport path portion P22. Thus, as shown in FIG. 3, the length of the first transport surface 110G in the transport direction D1 is less, to some extent, than the length of a sheet SH in the transport direction D1.

As shown in FIG. 1, the connecting unit 200 is disposed between the first coupling member 91 and the second coupling member 92 in the front-rear direction along which the sheet tray 2C is pulled out. A lower end 200D of the connecting unit 200 is located above a lower end 91D of the first coupling member 91 and a lower end 92D of the second coupling member 92.

Figure 7:
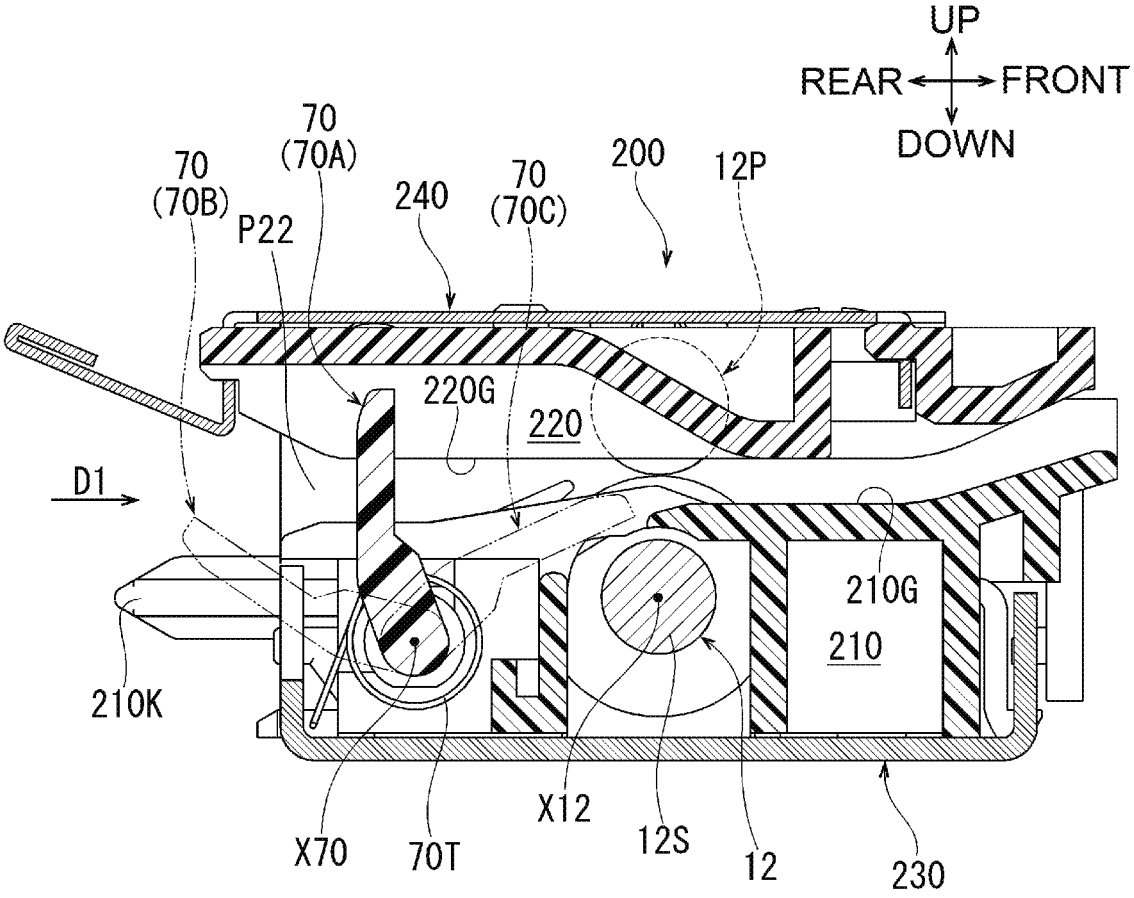
FIG. 7 is a cross-sectional view of the connecting unit.
Figure 8:
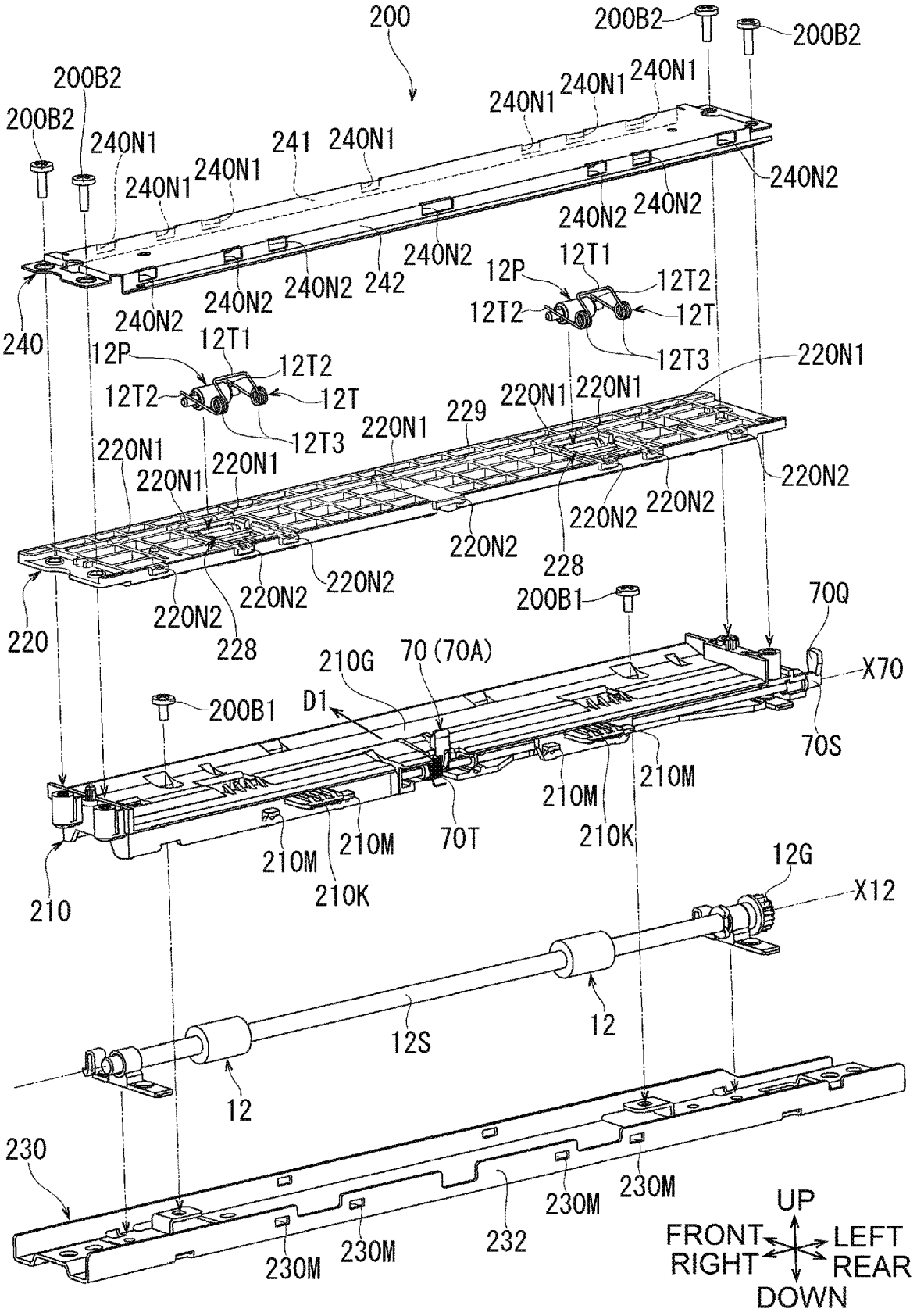
FIG. 8 is an exploded perspective view of the connecting unit.

As shown in FIGS. 2, 4, 5, 7, and 8, the connecting unit 200 includes a lower beam 230, a second guide member 210, a facing member 220, and an upper beam 240. As shown in FIG. 8, the lower beam 230, the second guide member 210, the facing member 220, and the upper beam 240 are coupled to each other with fastening screws 200B1 and 200B2.

The lower beam 230 is disposed at the bottom of the connecting unit 200. The lower beam 230, which may be a sheet metal member, extends in the left-right direction. As shown in FIG. 2, left and right ends of the lower beam 230 are connected to the respective side frames 90L and 90R. As shown in FIG. 5, the left and right ends of the lower beam 230 are positioned by positioning pins 90P which protrude upward from the respective side frames 90L and 90R.

As shown in FIGS. 5, 7, and 8, the second guide member 210, which may be molded from synthetic resin, is supported from below by the lower beam 230. The second guide member 210 includes, on its upper surface, a second transport surface 210G.

The second transport surface 210G extends substantially horizontally from a rear end to a front end of the upper surface of the second guide member 210. The second transport surface 210G defines from below the second retransport path portion P22. As shown in FIG. 2, the centerline LC1 passes through a center of the second transport surface 210G in the width direction.

As shown in FIGS. 5, 7, and 8, the second guide member 210 includes two positioning protrusions 210K. Each positioning protrusion 210K protrudes rearward from a rear surface of the second guide member 210 toward the first guide member 110 of the retransport unit 100. The positioning protrusions 210K are arranged to be aligned with corresponding positioning recesses 110K of the first guide member 110 and are spaced from each other in the width direction.

In a state in which the retransport unit 100 is located at the stored position, the positioning protrusions 210K are fitted in corresponding positioning recesses 110K. Thus, as shown in FIG. 2, the retransport unit 100 is positioned relative to the connecting unit 200 and the main body 2.

As shown in FIG. 8, the second guide member 210 includes a plurality of protrusions 210M. The protrusions 210M protrude rearward from a rear surface of the second guide member 210 substantially horizontally and are spaced from each other in the width direction.

The lower beam 230 includes, at its rear wall 232, a plurality of restrictors 230M. The restrictors 230M are substantially rectangular holes arranged to be aligned with corresponding protrusions 210M and are spaced from each other in the width direction.

In order for the second guide member 210 to be supported from below by the lower beam 230, the protrusions 210M are inserted in corresponding restrictors 230M such that an upper edge of each restrictor 230M contacts from above a corresponding protrusion 210M.

As shown in FIGS. 7 and 8, the facing member 220, which may be molded from synthetic resin, is disposed above the second guide member 210. As shown in FIG. 7, the facing member 220 faces the second transport surface 210G with a gap therebetween. The facing member 220 includes, on its lower surface, a guide surface 220G. The guide surface 220G defines from above the second retransport path portion P22.

As shown in FIGS. 4, 7, and 8, the upper beam 240 is disposed at the top of the connecting unit 200. The upper beam 240, which may be a sheet metal member, extends in the left-right direction. The upper beam 240 reinforces from above the facing member 220.

As shown in FIG. 8, the second guide member 220 includes a groove 229 and a plurality of hooks 220N1 and 220N2. The groove 229 is recessed downward from a front portion of an upper surface of the facing member 220, and extends in the left-right direction.

Hooks 220N1 protrude rearward, substantially horizontally, from an inner front surface of the groove 229 and are spaced from each other in the width direction. Hooks 220N2 protrude rearward, substantially horizontally, from a rear surface of the facing member 220 and are spaced from each other in the width direction.

The upper beam 240 includes, at its front wall 241, a plurality of engagement portions 240N1. The engagement portions 240N1 are substantially rectangular holes arranged to be aligned with corresponding hooks 220N1 and are spaced from each other in the width direction.

The upper beam 240 includes, at its rear wall 242, a plurality of engagement portions 240N2. The engagement portions 240N2 are substantially rectangular holes arranged to be aligned with corresponding hooks 220N2 and are spaced from each other in the width direction.

In order for the upper beam 240 to reinforce from above the facing member 220, a front wall 241 of the upper beam 240 is inserted into the groove 229 of the facing member 220 with the upper beam 240 shifted rearward relative to the facing member 220, and thereafter the upper beam 240 is shifted frontward. The engagement portions 240N1 engage corresponding hooks 220N1, and the engagement portions 240N2 engage corresponding hooks 220N2.

As shown in FIGS. 2, 5, 7, and 8, the second guide member 210 of the connecting unit 200 includes two second transport rollers 12. The second transport rollers 12 are each an example of a transport roller.

Each second transport roller 12 is rotatable about a second axis X12 parallel to the width direction, with its upper end exposed from the second transport surface 210G. As shown in FIG. 2, the second transport rollers 12 are spaced equidistantly from the centerline LC1 in the left-right direction.

As shown in FIGS. 7 and 8, the facing member 220 of the connecting unit 200 includes two pinch rollers 12P. Each pinch roller 12P is held by a corresponding one of two pinch roller holding portions 228 recessed in the facing member 220, as shown in FIG. 8, with its lower end exposed from the guide surface 220G, as shown in FIG. 7.

Two pushing members 12T are disposed, between the upper beam 240 and the facing member 220, to correspond to the two pinch rollers 12P. Coil portions 12T3 of each pushing member 12T are retained by protrusions formed at the facing member 220 at positions adjacent to a corresponding pinch roller holding portion 228. An end 12T1 of each pushing member 12T contacts from below the upper beam 240, and other ends 12T2 of each pushing member 12T contact from above left and right ends of a rotation shaft of a corresponding pinch roller 12P. Each pinch roller 12P is pushed, by a corresponding pushing member 12T, toward a corresponding second transport roller 12.

As shown in FIG. 5, a rotation shaft 12S of each second transport roller 12 extends in the left-right direction such that its left end is exposed from a left side of the second guide member 210. A spur gear 12G is fixed to the left end of the rotation shaft 12S.

As shown in FIG. 2, a second transmitter G2 is disposed at the left side frame 90L. The second transmitter G2, which is only schematically shown, includes a plurality of gears and transmission shafts to transmit a drive force from the drive source M1 to the second transport rollers 12 via the spur gear 12G and the rotation shaft 12S. The second transmitter G2 may include a clutch configured to switch between transmission and block of the drive force from the drive source M1.

The second transport rollers 12 and the pinch rollers 12P, which hereinafter may be collectively referred to as second transport roller pair(s) 12 and 12P, nip, on the second transport surface 210G, a sheet SH transported in a skewed manner by the skew roller 13P and the drive roller 13, and transport the sheet SH toward the return guide 69 which defines the third retransport path portion P23.

As shown in FIG. 1, the length of a portion of the retransport path P2 from the first transport roller 11 to each second transport roller 12 is set to be greater than the length in the transport direction D1 of a sheet SH to be retransported. This allows the skew roller 13P and the drive roller 13 alone to transport, in a skewed manner, a sheet SH spaced from the first transport roller 11 and the second transport rollers 12.

As shown in FIGS. 2, 5, 7, and 8, the second guide member 210 of the connecting unit 200 includes an actuator 70 for detecting whether a sheet SH passing on or over the second transport surface 210G is present. The actuator 70 is disposed at a rear end portion of the second transport surface 210G, and pivotable about a pivot axis X70 parallel to the width direction.

As shown in FIG. 2, the actuator 70 is disposed downstream of the skew roller 13P and upstream of the second transport rollers 12 in the transport direction D1. The actuator 70 is disposed on the centerline LC1.

As shown in FIG. 7, the second guide member 210 of the connecting unit 200 includes a torsion coil spring 70T. The torsion coil spring 70T is an example of an urging member. The torsion coil spring 70T exerts an urging force to urge the actuator 70 upstream in the transport direction D1.

The actuator 70 (70A) shown in FIGS. 2 and 7 through 9 is located at a first standby position and protrudes upward beyond the second transport surface 210G. In other words, the actuator 70 (70A) located at the first standby position protrudes into the second retransport path portion P22 defined between the second transport surface 210G and the guide surface 220G. As shown in FIG. 7, an upper end of the actuator 70 (70A) at the first standby position is positioned above the guide surface 220G.

The actuator 70 (70B) shown in FIGS. 5 and 7 pivots, due to the urging force of the torsion coil spring 70T, upstream in the transport direction D1 from the first standby position to a second standby position, and is held at the second standby position.

The actuator 70 (70A) shown in FIG. 7 is pressed by a sheet SH passing on or over the second transport surface 210G to move, against the urging force of the torsion coil spring 70T, downstream in the transport direction D1 from the first standby position to a passage allowing position. The actuator 70 (70C) at the passage allowing position is retracted below the second transport surface 210G to allow the sheet SH to pass.

As shown in FIG. 2, when the retransport unit 100 moves from the pulled-out position to the stored position, the actuator pusher 110J of the first guide member 110 pushes forward the actuator 70. Thus, the actuator 70 (70A) is held at the first standby position.

In contrast, as shown in FIG. 5, when the retransport unit 100 moves from the stored position to the pulled-out position, the actuator pusher 110J of the first guide member 110 moves rearward away from actuator 70, and the actuator 70 pivots upstream in the transport direction D1 from the first standby position. Thus, the actuator 70 (70B) is held at the second standby position.

As shown in FIGS. 2, 5, and 8, a pivot shaft 70S of the actuator 70 extends in the left-right direction such that its left end is exposed from the left side of the second guide member 210. The left end of the pivot shaft 70S includes a detected portion 70Q. The detected portion 70Q is a plate piece protruding radially about the pivot axis X70 in the same direction as the actuator 70 protrudes.

As schematically shown in FIG. 2, a photo-interrupter 70U is disposed at the left side frame 90L at a position corresponding to the detected portion 70Q. When the detected portion 70Q blocks a light path from a light emitter to a light receiver, the photo-interrupter 70U detects that the actuator 70 is at the first standby position and transmits an ON signal to the controller C1. When the detected portion 70Q unblocks a light path from the light emitter to the light receiver, the photo-interrupter 70U detects that the actuator 70 is not at the first standby position and transmits an OFF signal to the controller C1.

In a state in which the drive source M1 is inactive, the controller C1 determines that the retransport unit 100 is at the stored position upon receipt of an ON signal from the photo-interrupter 70U and determines that the retransport unit 100 is not at the stored position upon receipt of an OFF signal from the photo-interrupter 70U.

In a state in which the drive source M1 is active, the controller C1 determines, upon receipt of an ON signal from the photo-interrupter 70U, that the actuator 70 is at the first standby position and that no sheet SH is present on the second transport surface 210G, and determines, upon receipt of an OFF signal from the photo-interrupter 70U, that the actuator is at the passage allowing position and that a sheet SH is present on the second transport surface 210G.

In short, the actuator 70 is used for detection of the presence and absence of a sheet SH on the second transport surface 210G, as well as the position of the retransport unit 100.

The image forming apparatus 1 may simultaneously process a plurality of sheets SH to improve throughput in duplex mode for forming images on both sides of a sheet SH. In an example, a sheet SH may be caused to wait in the middle of the retransport path P2 to allow a next sheet SH to be transported to the image forming unit 3. In this case, the controller C1 causes a sheet SH to wait in the middle of the retransport path P2 on the basis of the position of the actuator 70 for detecting whether a sheet SH is present on the second transport surface 210G.

Action of Skew Roller and Reference Guide on Retransported Sheet

FIG. 9 shows a state of a sheet SH (SHa) transported further in the transport direction D1 after the sheet SH (SHa) is nipped by the first transport roller pair 11 and 11P and the skew roller pair 13 and 13P. In this state, the sheet SH (SHa), whose trailing edge is spaced from the first transport roller pair 11 and 11P, starts being transported by the skew roller pair 13 and 13P alone. A sheet SH being transported by the skew roller pair 13 and 13P alone indicates a state in which a sheet SH is transported by the skew roller pair 13 and 13P alone, with its trailing edge located downstream of the first transport roller pair 11 and 11P and its leading edge located upstream of the second transport roller pairs 12 and 12P in the transport direction D1. The sheet SH (SHa) shown in FIG. 9 by way of example is misaligned in the width direction and skewed relative to the centerline LC1.

The skew roller pair 13 and 13P transports the sheet SH (SHa) in such a state toward the reference wall 32 of the reference guide 30. This causes a left edge of the sheet SH (SH a) to contact the front end of the side wall 118A of the side chute 118, while being skewed relative to the left reference line LL1.

The skew roller pair 13 and 13P turns, the sheet SH (SHa) on the first transport surface 110G, clockwise in FIG. 9 about the front end of the side wall 118A. Consequently, as shown in FIG. 9, the left edge of the sheet SH (SHa) follows the reference wall 32 of the reference guide 30.

In this way, the retransport assembly 10 properly restricts the position of the sheet SH in the width direction such that the left edge of the sheet SH (SHb) is aligned with the left reference line LL1 and a center of the sheet SH (SHb) in the width direction is aligned with the centerline LC1.

In addition, when the skew roller pair 13 and 13P alone transports the sheet SH (SHb) in the transport direction D1, the actuator 70 (70A) at the first standby position is pushed by the sheet SH (SHb) to pivot to the passage allowing position. Consequently, the controller C1 determines that the sheet SH is present on the second transport surface 210G and uses this determination for various timing controls.

As shown in FIG. 9, the sheet SH (SHc), when nipped by the skew roller pair 13 and 13P and the two transport roller pairs 12 and 12P, is less likely to change in orientation and is transported further toward the third retransport pass portion P23.

Effects

In the image forming apparatus 1 according to the above-described embodiment, the retransport unit 100 defining the first retransport path portion P21 and the connecting unit 200 defining the second retransport path portion P22 are disposed below the sheet tray 2C and extend frontward horizontally, and are connected to each other. The retransport unit 100 is movable between the stored position (shown in FIG. 1) and the pulled-out position (shown in FIG. 3).

In the above-described image forming apparatus 1, the retransport unit 100 and the connecting unit 200 are separate from each other. The retransport unit 100 is configured to be pulled out from the main body 2. This allows the first retransport path portion P21 to be shorter than the length of a sheet SH to be retransported along the first retransport path portion P21.

When a sheet jam occurs in the retransport path P2, a jammed sheet SH is made visible by a user pulling out the retransport unit 100 from the stored position to the pulled-out position. Accordingly, the user is allowed to readily remove the jammed sheet SH by holding an edge of the sheet SH exposed from the retransport unit 100.

In the above-described image forming apparatus 1, the retransport unit 100 and the connecting unit 200 define a portion of the retransport path P2. It is new that the retransport unit 100 is configured to be pulled out from the main body 2. This may facilitate removal of any sheet SH jammed in the retransport path P2.

In the above-described image forming apparatus 1, as shown in FIGS. 1 and 2, the main body 2 includes the first coupling member 91 and the second coupling member 92 which are disposed below the sheet tray 2C. Each of the first coupling member 91 and the second coupling member 92 extends in the width direction and is coupled to the side frames 90L and 90R. The second coupling member 92 is spaced from and disposed behind the first coupling member 91 in the pulling direction of the sheet tray 2C. The connecting unit 200 is disposed between the first coupling member 91 and the second coupling member 92 in the pulling direction. The connecting unit 200 is disposed between the first coupling member 91 and the second coupling member 92 which are coupled to the pair of side frames 90L and 90R to reinforce the main body 2. This allows the main body 2 to properly support the connecting unit 200.

In the above-described image forming apparatus 1, as shown in FIG. 1, the lower end 200D of the connecting unit 200 is located above the lower end 91D of the first coupling member 91 and the lower end 92D of the second coupling member 92. Even when any load is applied to a lower surface of the main body 2 from an uneven installation site of the image forming apparatus 1, the first coupling member 91 and the second coupling member 92 may receive the load and prevent or reduce the load applied to the connecting unit 200. Thus, deformation of the connecting unit 200 may be prevented or reduced.

In the above-described image forming apparatus 1, as shown in FIG. 2, the retransport unit 100 includes the first guide member 110 having the first transport surface 110G, the reference guide 30 disposed on the left reference line LL1, and the skew roller 13P rotatable about the first axis X13P inclined relative to the width direction. The connecting unit 200 includes the second transport rollers 12 rotatable about the second axis X12 parallel to the width direction. This structure allows the second transport rollers 12 to be accurately positioned relative to the main body 2, regardless of the retransport unit 100 moving between the stored position and the pulled-out position. This allows the second transport rollers 12 to accurately or straightly transport, a sheet SH transported in a skewed manner by the skew roller 13P, toward the third retransport path portion P23.

In the above-described image forming apparatus 1, as shown in FIG. 2, the left side frame 90L is provided with the first transmitter G1 for transmitting a drive force from the drive source M1 via the drive roller 13 to the skew roller 13P, and the second transmitter G2 for transmitting a drive force from the drive source M1 to the second transport rollers 12. Unlike the above-described embodiment, if a transmitter is configured to transmit a drive force from the drive source M1 to one of the retransport unit 100 and the connecting unit 200, and to transmit the drive force from the one of the retransport unit 100 and the connecting unit 200 to the other of the retransport unit 100 and the connecting unit 200, the transmitter is required to connect or block transmission of the drive force upon movement of the retransport unit 100 between the stored position and the pulled-out position, causing a complex structure of the transmitter. In this respect, the first transmitter G1 and the second transmitter G2 has a relatively simple structure.

In the above-described image forming apparatus 1, as shown in FIGS. 5 and 7, the connecting unit 200 includes the actuator 70 for detecting whether a sheet SH passing on or over the second transport surface 210G is present. As shown in FIG. 3, when the retransport unit 100 is moved to the pulled-out position, the actuator 70 remains in the main body 2 and thus is less likely to be broken. Regardless of the retransport unit 100 moving between the stored position and the pulled-out position, a positional relation between the detected portion 70Q of the actuator 70 disposed at the connecting unit 200 and the photo-interrupter 70U disposed at the main body 2 as shown in FIG. 2 may be constantly maintained, thereby ensuring an accurate detection of a sheet SH.

In the above-described image forming apparatus 1, as shown in FIG. 7, when the retransport unit 100 moves from the pulled-out position to the stored position, the actuator 70 is held at the first standby position shown by reference character 70A. When the actuator 70 moves from the stored position to the pulled-out position, the actuator 70 pivots, due to the urging force of the torsion coil spring 70T, upstream in the transport direction D1 from the first standby position to the second standby position, and is held at the second standby position shown by reference character 70B. When pushed by a sheet SH passing on or over the second transport surface 210G, the actuator 70 pivots from the first standby position to the passage allowing position. This structure allows, in a state in which the drive source M1 is inactive, the controller C1 to determine that the retransport unit 100 is at the pulled-out position upon receipt of an OFF signal from the photo-interrupter 70U with its light path unblocked by the detected portion 70Q of the actuator 70. In short, the actuator 70 is used for detection of the presence and absence of a sheet SH, as well as the position of the retransport unit 100. Consequently, reduction in the number of components and downsizing may be achieved in the image forming apparatus 1.

In the above-described image forming apparatus 1, as shown in FIGS. 2 and 5, the connecting unit 200 includes, at its bottom, the lower beam 230. The lower beam 230, which is a sheet metal member, extends in the width direction and is positioned relative to the side frames 90L and 90R, thereby preventing or reducing defamation of the connecting unit 200.

In the above-described image forming apparatus 1, as shown in FIG. 5, the connecting unit 200 includes the second transport rollers 12, and the second guide member 210 having the second transport surface 210G. The second guide member 210 has the two positioning protrusions 210K. As shown in FIG. 6, the first guide member 110 of the retransport unit 100 has the two positioning recesses 110K. In a state in which the retransport unit 100 is located at the stored position, the positioning protrusions 210K are fitted in the corresponding positioning recesses 110K, thereby, as shown in FIG. 2, accurately positioning the retransport unit 100 at the stored position relative to the connecting unit 200 and eventually relative to the main body 2.

In the above-described image forming apparatus 1, as shown in FIG. 8, the protrusions 210M of the second guide member 210 are respectively inserted in the restrictors 230M of the lower beam 230 such that the restrictors 230M respectively contact from above the protrusions 210M. In this case, the positioning protrusions 210K fitted in the positioning recesses 110K may generate such a force that the first guide member 110 of the retransport unit 100 moves up the second guide member 210 of the connecting unit 200. Even in this case, the restrictors 230M respectively contact from above the protrusions 210M, thereby restricting the second guide member 210 from moving up from the lower beam 230. Consequently, this may prevent the second transport surface 210G from being reversely stepped relative to the first transport surface 110G or being raised relative thereto.

In the above-described image forming apparatus 1, the facing member 220 of the connecting unit 200 includes the guide surface 220G (shown in FIG. 7) and the pinch roller holding portions 228 (shown in FIG. 8) which hold the pinch rollers 12P. The facing member 220 functions to guide from above a sheet SH guided on the second surface 210G and to hold the pinch rollers 12P, thereby reducing the number of components.

In the above-described image forming apparatus 1, as shown in FIG. 8, the pushing members 12T are disposed between the upper beam 240 and the facing member 220. The engagement portions 240N1 and 240N2 of the upper beam 240 are respectively engaged with the hooks 220N1 and 220N2 of the facing member 220. With this structure, the engagement portions 240N1 and 240N2 respectively engaged with the hooks 220N1 and 220N2 may prevent the upper beam 240 from moving upward due to reaction forces of the pushing members 12T. Consequently, the upper beam 240 suitably receives the reaction forces of the pushing members 12T, thereby stabilizing pushing forces exerted by the pushing members 12T on the pinch rollers 12P.

In the above-described image forming apparatus 1, as shown in FIG. 1, the extending portion 2C1 is formed at the front end of the sheet tray 2C which is an end of the sheet tray 2C farther from the retransport unit 100 than the connecting unit 200 is. The extending portion 2C1 extends downward beyond the bottom surface 2C2 of the sheet tray 2C to be side by side with the connecting unit 200 in the front-rear direction. The upstream end of the third retransport path portion P23 in the transport direction D1 is located at the extending portion 2C1. With this structure, the transport direction D1 in the third retransport path portion P23 is changed from horizontally frontward to up. Consequently, the second retransport path portion P22 is allowed to extend horizontally, and the shape of the connecting unit 200 is simplified.

While the disclosure has been described with reference to a particular embodiment thereof, various changes, arrangements and modifications may be applied therein without departing from the spirit and scope of the disclosure.

For example, the connecting unit 200 may extend to a space, which is occupied by the extending portion 2C1 according to the above-described embodiment, such that a downstream end in the transport direction D1 of the second retransport path portion P22 is directed upward and connected to an upstream end in the transport direction D1 of the third retransport path portion P23.

The first guide member 110 of the retransport unit 100 may include positioning protrusions which are similar to the positioning protrusions 210K according to the above-described embodiment, and the second guide member 210 of the connecting unit 200 may include positioning recesses which are similar to the positioning recesses 110K according to the above-described embodiment.

What is claimed is:

1. An image forming apparatus comprising:

a main body;

an image forming unit disposed at the main body and configured to form an image on a sheet;

a sheet tray disposed below the image forming unit, extending horizontally, and configured to hold sheets to be fed to the image forming unit; and a retransport assembly configured to transport, along a retransport path, the sheet, which has an image on one side thereof, back toward the image forming unit to form an image on the other side of the sheet, the retransport path including a first retransport path portion, a second retransport path portion, and a third retransport path portion in a transport direction, the retransport assembly including:

a particular portion of the sheet tray defining the third retransport path portion;

a connecting unit disposed below the sheet tray, extending horizontally, and defining the second retransport path portion, which is connected to an upstream end of the third retransport path portion in the transport direction; and a retransport unit disposed below the sheet tray, extending horizontally, and movable between a stored position at which the retransport unit is stored inside the main body and a pulled-out position at which the retransport unit is pulled out from the stored position, the retransport unit at the stored position defining the first retransport path portion connected to an upstream end of the second retransport path portion, wherein the main body includes:

a pair of side frames disposed on opposite sides of the sheet tray to face each other in a width direction of the sheet transported along the retransport path, and supporting the sheet tray such that the sheet tray is pulled out in a pulling direction;

a first coupling member disposed below the sheet tray, extending in the width direction, and coupled to the pair of side frames; and a second coupling member disposed below the sheet tray, spaced from the first coupling member in the pulling direction, extending in the width direction, and coupled to the pair of side frames, wherein the connecting unit is disposed between the first coupling member and the second coupling member in the pulling direction.

2. The image forming apparatus according to claim 1, wherein a lower end of the connecting unit is located above a lower end of the first coupling member and a lower end of the second coupling member.

3. The image forming apparatus according to claim 1, wherein the particular portion of the sheet tray is located at an end of the sheet tray farther from the retransport unit than the connecting unit, and extends downward beyond a bottom surface of the sheet tray, and wherein the upstream end of the third retransport path portion is located at the particular portion.

4. An image forming apparatus comprising:

a main body;

an image forming unit disposed at the main body and configured to form an image on a sheet;

a sheet tray disposed below the image forming unit, extending horizontally, and configured to hold sheets to be fed to the image forming unit; and a retransport assembly configured to transport, along a retransport path, the sheet, which has an image on one side thereof, back toward the image forming unit to form an image on the other side of the sheet, the retransport path including a first retransport path portion, a second retransport path portion, and a third retransport path portion in a transport direction, the retransport assembly including:

a particular portion of the sheet tray defining the third retransport path portion;

a connecting unit disposed below the sheet tray, extending horizontally, and defining the second retransport path portion, which is connected to an upstream end of the third retransport path portion in the transport direction; and a retransport unit disposed below the sheet tray, extending horizontally, and movable between a stored position at which the retransport unit is stored inside the main body and a pulled-out position at which the retransport unit is pulled out from the stored position, the retransport unit at the stored position defining the first retransport path portion connected to an upstream end of the second retransport path portion, wherein the retransport unit includes:

a first guide member including a first transport surface configured to guide the sheet;

a reference wall positioned at an end of the first transport surface in a width direction of the sheet transported along the retransport path, the reference wall extending along the transport direction; and a skew roller pair including a skew roller configured to rotate about a first axis inclined relative to the width direction, the skew roller pair being configured to transport in a skewed manner the sheet on the first transport surface toward the reference wall, and wherein the connecting unit includes a transport roller configured to rotate about a second axis parallel to the width direction to transport the sheet transported along the reference wall toward the third retransport path portion.

5. The image forming apparatus according to claim 4, wherein the main body includes a pair of side frames disposed on opposite sides of the sheet tray to face each other in the width direction, and wherein one of the pair of side frames includes a first transmitter configured to transmit a drive force to the skew roller, and a second transmitter configured to transmit a drive force to the transport roller.

6. The image forming apparatus according to claim 4, wherein the particular portion of the sheet tray is located at an end of the sheet tray farther from the retransport unit than the connecting unit, and extends downward beyond a bottom surface of the sheet tray, and wherein the upstream end of the third retransport path portion is located at the particular portion.

7. An image forming apparatus comprising:

a main body;

an image forming unit disposed at the main body and configured to form an image on a sheet;

a sheet tray disposed below the image forming unit, extending horizontally, and configured to hold sheets to be fed to the image forming unit; and a retransport assembly configured to transport, along a retransport path, the sheet, which has an image on one side thereof, back toward the image forming unit to form an image on the other side of the sheet, the retransport path including a first retransport path portion, a second retransport path portion, and a third retransport path portion in a transport direction, the retransport assembly including:

a particular portion of the sheet tray defining the third retransport path portion;

a connecting unit disposed below the sheet tray, extending horizontally, and defining the second retransport path portion, which is connected to an upstream end of the third retransport path portion in the transport direction; and a retransport unit disposed below the sheet tray, extending horizontally, and movable between a stored position at which the retransport unit is stored inside the main body and a pulled-out position at which the retransport unit is pulled out from the stored position, the retransport unit at the stored position defining the first retransport path portion connected to an upstream end of the second retransport path portion, wherein the connecting unit includes:

an actuator; and, an urging member configured to exert an urging force that urges the actuator upstream in the transport direction, and wherein the actuator is configured to:

when the retransport unit moves from the pulled-out position to the stored position, be held at a first standby position to protrude into the second retransport path portion defined by the connecting unit, and when the retransport unit moves from the stored position to the pulled-out position, move from the first standby position, due to the urging force, upstream in the transport direction and to be held at a second standby position.

8. The image forming apparatus according to claim 7, wherein the particular portion of the sheet tray is located at an end of the sheet tray farther from the retransport unit than the connecting unit, and extends downward beyond a bottom surface of the sheet tray, and wherein the upstream end of the third retransport path portion is located at the particular portion.

9. An image forming apparatus comprising:

a main body;

an image forming unit disposed at the main body and configured to form an image on a sheet;

a sheet tray disposed below the image forming unit, extending horizontally, and configured to hold sheets to be fed to the image forming unit; and a retransport assembly configured to transport, along a retransport path, the sheet, which has an image on one side thereof, back toward the image forming unit to form an image on the other side of the sheet, the retransport path including a first retransport path portion, a second retransport path portion, and a third retransport path portion in a transport direction, the retransport assembly including:

a particular portion of the sheet tray defining the third retransport path portion;

a connecting unit disposed below the sheet tray, extending horizontally, and defining the second retransport path portion, which is connected to an upstream end of the third retransport path portion in the transport direction; and a retransport unit disposed below the sheet tray, extending horizontally, and movable between a stored position at which the retransport unit is stored inside the main body and a pulled-out position at which the retransport unit is pulled out from the stored position, the retransport unit at the stored position defining the first retransport path portion connected to an upstream end of the second retransport path portion, wherein the main body includes a pair of side frames disposed on opposite sides of the sheet tray to face each other in a width direction of the sheet transported along the retransport path, and wherein the connecting unit includes a lower beam disposed at a bottom of the connecting unit, extending in the width direction, and positioned relative to the pair of side frames.

10. The image forming apparatus according to claim 9, wherein the connecting unit includes:

a transport roller configured to rotate about a second axis parallel to the width direction to transport the sheet toward the third retransport path portion; and a second guide member supported from below by the lower beam and including a second transport surface configured to guide the sheet, and wherein one of the retransport unit and the second guide member includes a positioning protrusion protruding toward the other of the retransport unit and the second guide member, and the other of the retransport unit and the second guide member includes a positioning recess configured to receive the positioning protrusion when the retransport unit is located at the stored position.

11. The image forming apparatus according to claim 10, wherein the second guide member includes a protrusion protruding substantially horizontally, and the lower beam includes a restrictor contactable, from above, with the protrusion.

12. The image forming apparatus according to claim 10, wherein the connecting unit includes a facing member disposed above the second guide member and facing the second transport surface with a gap therebetween, and the facing member holds a pinch roller pushed toward the transport roller.

13. The image forming apparatus according to claim 12, wherein the connecting unit includes:

an upper beam reinforcing the facing member from above; and a pushing member disposed between the upper beam and the facing member, and pushing the pinch roller toward the transport roller, and wherein the facing member includes a plurality of hooks, and the upper beam includes a plurality of engagement portions respectively engaged with the plurality of hooks.

14. The image forming apparatus according to claim 9, wherein the particular portion of the sheet tray is located at an end of the sheet tray farther from the retransport unit than the connecting unit, and extends downward beyond a bottom surface of the sheet tray, and wherein the upstream end of the third retransport path portion is located at the particular portion.

* * * * *